US005806746A

United States Patent [19]

Holbrook et al.

[11] Patent Number: 5,806,746

[45] Date of Patent: Sep. 15, 1998

[54] METHOD AND APPARATUS FOR GUIDING WEBS IN A WEB HANDLING SYSTEM

[75] Inventors: Russell W. Holbrook, Southbury; William D. Toth, Milford, both of Conn.

[73] Assignee: Pitney Bowes Inc., Stamford, Conn.

[21] Appl. No.: 733,460

[22] Filed: Oct. 18, 1996

[51] Int. Cl.[6] ..... B65H 20/00; B65H 23/32

[52] U.S. Cl. ..... 226/95; 226/97; 226/199

[58] Field of Search ..... 226/93, 95, 97, 226/196, 199; 242/615.1, 615.3

[56] References Cited

U.S. PATENT DOCUMENTS

| | | | |
|---|---|---|---|
| 3,741,116 | 6/1973 | Green et al. | 226/95 |
| 4,635,916 | 1/1987 | Modugno et al. | 226/199 |
| 4,871,273 | 10/1989 | Fields | 226/199 |
| 4,925,081 | 5/1990 | Vecchi | 226/199 |
| 4,991,787 | 2/1991 | Berg | 226/199 |
| 5,003,889 | 4/1991 | Glunz et al. | 226/199 |
| 5,016,801 | 5/1991 | Gilat et al. | 226/199 |
| 5,142,482 | 8/1992 | Sansone | 364/478 |

*Primary Examiner*—Charles A. Marmor
*Assistant Examiner*—Matthew A. Kaness
*Attorney, Agent, or Firm*—Christopher J. Capelli; Melvin J. Scolnick; Robert Meyer

[57] ABSTRACT

A web guide particularly adapted for mail handling systems is positioned between the mail handling system form feeder and separating device. The web guide provides a surface to guide and control the web during its travel between the feeder and separating device so as to avoid or minimize premature tearing of the web, particularly during web acceleration caused by the separating device.

4 Claims, 3 Drawing Sheets

33
10
25
27
29
31
21
23
25
27
29
31
11
23
27
21
23
17
19
27
29
13
12

METHOD AND APPARATUS FOR GUIDING WEBS IN A WEB HANDLING SYSTEM

FIELD OF THE INVENTION

The present invention is directed to a method and apparatus for guiding webs in systems handling a continuum of travelling material and, in particular, to a web guide disposed between a mail handling form feeder and a separating device to avoid tearing of the web during mail processing.

BACKGROUND ART

Automated mail processing systems have been developed in the prior art to reduce the effort required on the part of the Post Office for processing mail. In one conventional mail processing system disclosed in U.S. Pat. No. 5,142,482, herein incorporated in its entirety by reference, a mainframe computer is provided which is in communication with a printer and a sheet feeder. The purpose of the connection between the computer and the printer is to provide data to the printer to cause the printing of names and addresses of mail recipients on address sheets or webs that are fed by the sheet feeder. Other data such as bills, account statements, late payment notices and the like could also be fed from the form or sheet feeder. The sheets may be in the form of a perforated web that is subsequently separated by a separating device typically referred to as a burster or cutter. Once the webs are separated into sheets, the sheets are fed to an inserter which places the sheets into envelopes and seals the envelopes for mailing.

These types of mail handling systems are not without their disadvantages. Often times, webs being dispensed from the form or sheet feeder are not well controlled prior to entry into the cutter. The webs tend to whip around and can be subsequently torn at the perforation line prior to web entry into the separating device. This action can be caused or aggravated by acceleration of the separating device during a high-speed run.

As such, a need has developed to provide an improved mail handling apparatus which overcomes the problem of loss of web travel control between the mail handling form feeder and the separating device or any other system handling a continuum of travelling material to be separated.

In response to this need, the present invention provides a web guide which is positioned between the form feeder and a separating device to control the web travel during a run to avoid premature tearing of the web or other malfunction which may interrupt the continuity of the system.

SUMMARY OF THE INVENTION

Accordingly, it is a first object of the present invention to provide an improved mail handling apparatus.

Another object of the present invention is to provide a mail handling apparatus which controls the travel of one or more webs exiting a form feeder and into a separating device.

A still further object of the present invention is to provide a method for controlling the travel of one or more webs in a mail handling system by guiding the webs during travel between a form feeder and a separating device.

Another object of the present invention is to provide a method and apparatus for guiding a web between the form feeder and the separating device in any system handling a continuum of a travelling web or the like.

Other objects and advantages of the present invention will become apparent as a description thereof proceeds.

In satisfaction of the foregoing objects and advantages, the present invention, in one embodiment, provides an improvement in a system apparatus having a form feeder and a separating device wherein at least one web is fed from the form feeder to the separating device during system operation. According to the present invention, a web guide is positioned between the form feeder and separating device, the web guide having a web guide surface to control or guide the travel of the web between the form feeder and separating device.

Preferably, the web guide surface includes upstanding walls which are horizontally adjustable to accommodate different web heights. The web guide can also be vertically adjustable and angularly adjustable with respect to an axis of web travel to accommodate different web travel paths between a given form feeder and a separating device.

The web guide could also include a vacuum-producing device which is capable of pulling a vacuum against the web to assist in guiding the web during its travel. The vacuum device could be controllable to accommodate different types and/or sizes of webs.

More preferably, the web guide comprises a frame having an upstanding support extending therefrom and a pair of web guide decks extending laterally from the upstanding support. Each web guide deck can have a pair of guide walls with a web guide surface therebetween. The guide walls can be made horizontally adjustable to accommodate webs of varying widths. Each web guide deck can also be vertically adjustable with respect to the upstanding support to accommodate form feeders dispensing webs at varying heights. The decks can be angularly adjustable with respect to the web guide surface or web longitudinal axis to accommodate different angles of dispensing from the form feeder or feeding to the separating device.

The vacuum device is preferably a fan with the fan inlet arranged in communication with the web guide surface so that the fan inlet provides the desired suction.

In another aspect of the invention, a method of controlling the travel of at least one web exiting a form feeder and entering the separating device of a system treating a continuum of material such as a mail handling system comprises the steps of providing at least one web being dispensed from the form feeder and guiding the web during its travel between the form feeder and the separating device to avoid web tearing during web travel. During the guiding step, a vacuum could be applied to the web to further assist in maintaining control over the web during its travel. The guiding step could also include vertical, horizontal and/or angular adjustment to accommodate webs travelling in different orientations and/or directions from the form feeder or to the separating device. The vacuum can also be controlled to accommodate webs of different sizes and/or types.

BRIEF DESCRIPTION OF THE DRAWINGS

Reference is now made to the drawings of the invention wherein.

DESCRIPTION OF THE PREFERRED EMBODIMENTS

Figure 1:
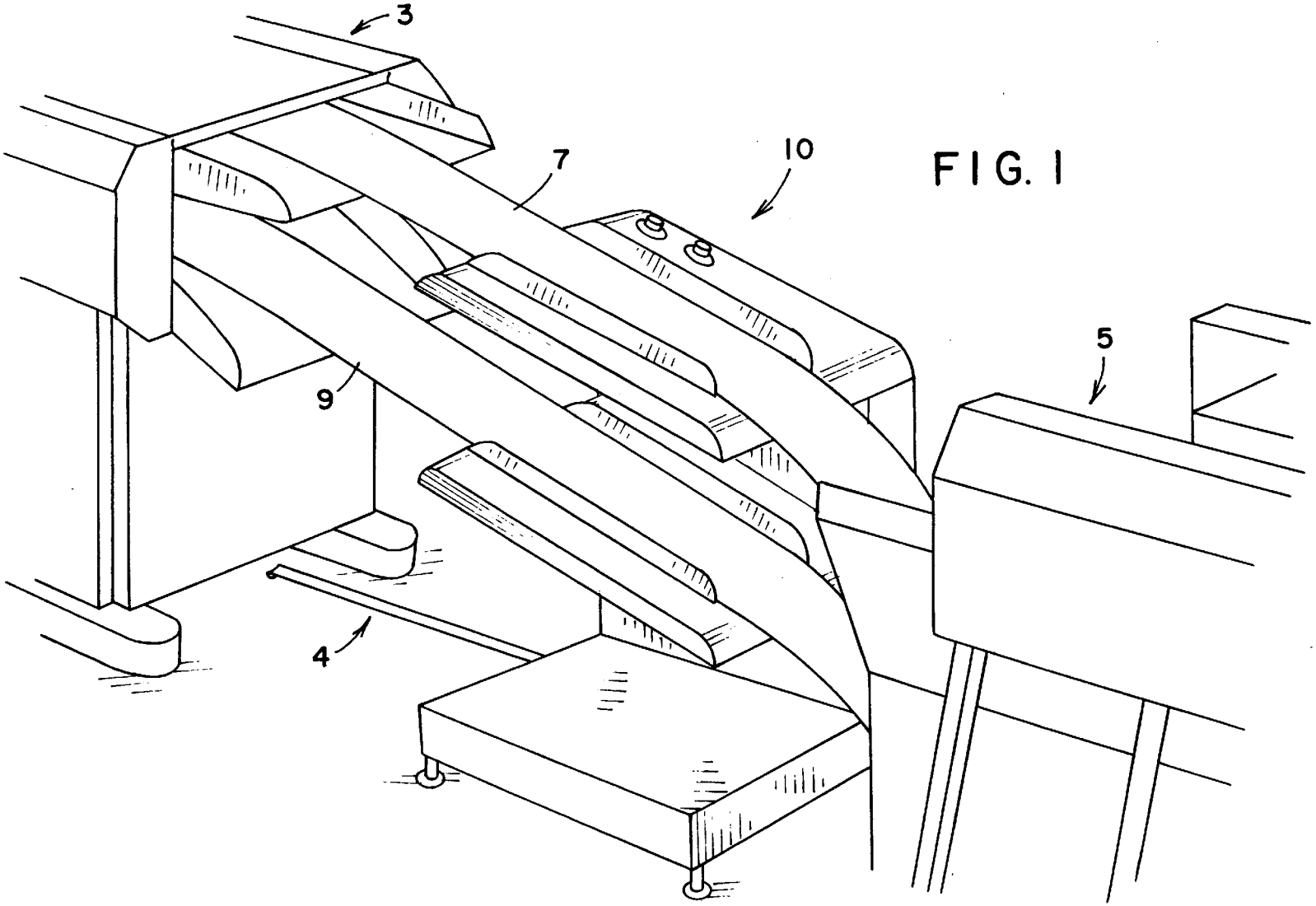
FIG. 1 is a perspective view of the inventive web guide in an exemplary use.

With reference now to FIG. 1, the inventive web guide device is generally designated by the reference numeral 10 and is shown disposed between a form feeder 3 and a cutter 5 of a conventional mail handling system. The form feeder 3 dispenses a pair of webs 7 and 9 to the cutter 5, the cutter 5 tearing the webs 7 and 9 at perforations thereof to form sheets for insertion into a given envelope. The form feeder 3 and cutter 5 are conventional apparatus in mail handling systems and do not require further detailed description for understanding of the invention. Although a cutter is depicted, any device that can separate the webs such as a burster, a laser cutter, a sheeting device or the like can be used as a separating device downstream of the web guide.

The web guide 10 is disposed between the form feeder 3 and the cutter 5 so as to guide the webs 7 and 9 and to prevent either web tangling, web loss of control during web travel or premature tearing of the web prior to entry into the cutter 5. The web guide can be positioned at any point between the form feeder 3 and cutter 5 so long as adequate support is provided to the webs 7 and 9 during their travel. Preferably, the web guide 10 has a tape measuring device 4 to assist in positioning the web guide between the form feeder 3 and the cutter 5. The tape measuring device 4 is mounted within the web guide 10 and can be pulled out similarly to a conventional tape measure for web guide positioning.

Figure 2:
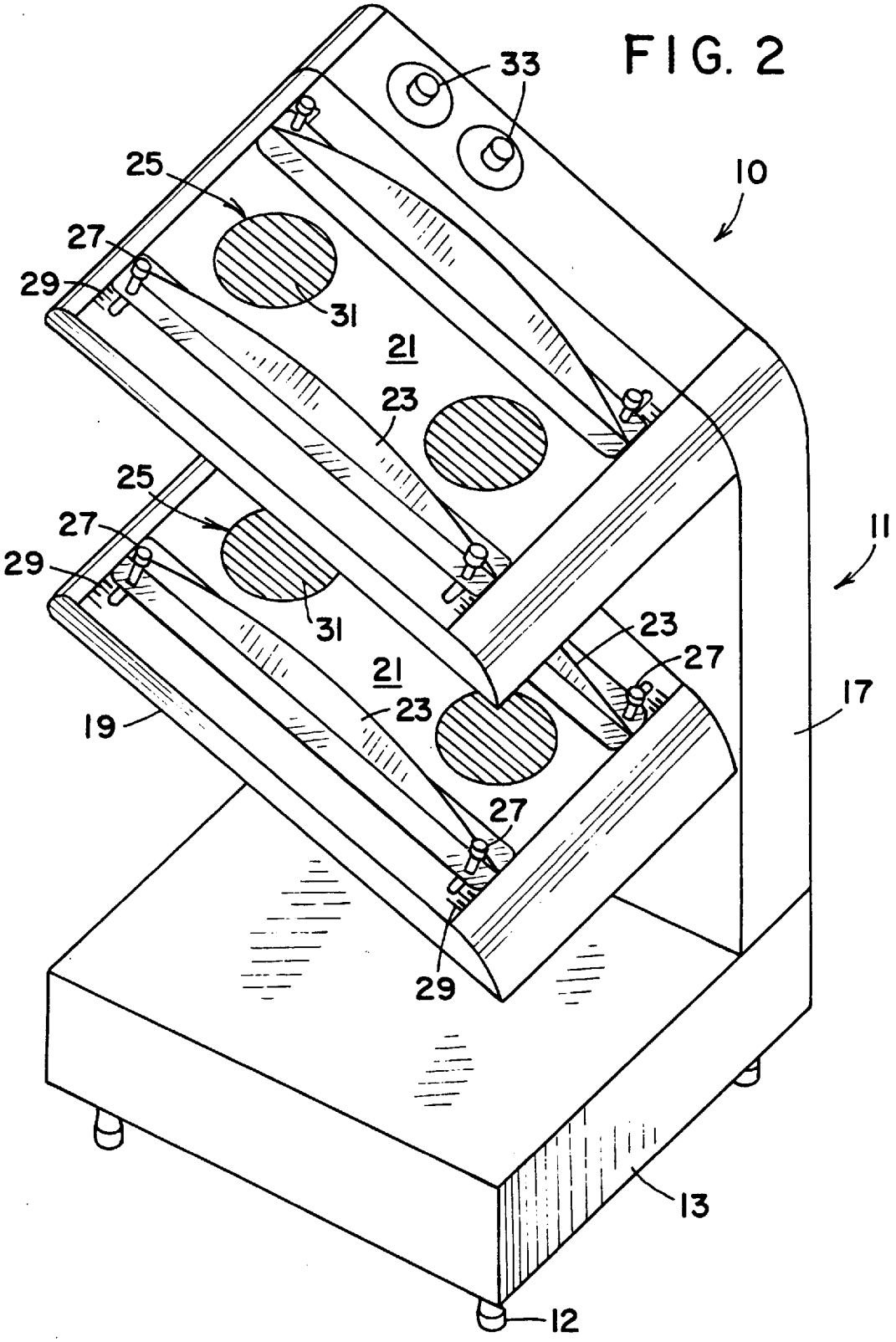
FIG. 2 is a perspective view of the inventive web guide enlarged to show greater detail.

Referring now to FIG. 2, the web guide 10 includes a frame 11 which is comprised of legs 12, a base 13 and an upstanding support 17. Extending laterally from a side of the upstanding support 17 are a pair of decks 19. Each deck 19 provides a web guiding surface 21 thereon to support the webs during their travel to the cutter 5.

In the embodiment depicted in FIG. 2, each deck 19 includes a pair of guide walls 23 which guide the webs 7 and 9 along their respective edges during web travel.

The guide walls 23 can be made horizontally adjustable by means of the pegs 27 riding in the slots 29 in the deck 19. Of course, other ways or means could be used to provide the horizontal adjustment of the guide walls 23 as would be known in the art. It should also be understood that the guide walls 23 could be fixed or the decks 19 alone could be used merely to support the underside of the webs 7 and 9 without any guide walls, if so desired.

The decks 19 could also include gradations 29 on the surface thereof to facilitate setting the guide walls in a given position to accommodate standard width webs.

In another aspect of the invention, vacuum devices 25 can be provided in each deck 19. The vacuum devices 25 are preferably fans with inlets 31 arranged in the web guiding surface 21. In FIG. 2, a pair of vacuum devices 25 are shown for each deck 19 but the number can vary depending on the size of the deck and given application in a particular mail handling system.

In use, each fan (blades not shown) pulls a vacuum an inlet 31 to apply a downward force on the web as it travels on the guide surface 21. With this downward force, the web is maintained more securely along the guide surface 21 during its travel between form feeder 3 and the cutter 5.

Fan speed control 33 can be provided on the support 17, one control for each deck 19. The fan speed control 33 can control the speed of the fan and resulting vacuum to apply different degrees of downward force on a given web. For example, a heavier gauge web would require a higher downward force and a higher fan speed. Similarly, lighter gauge webs would require less of a vacuum to maintain the web in contact with the guide surface 21 during its travel.

Figure 3:
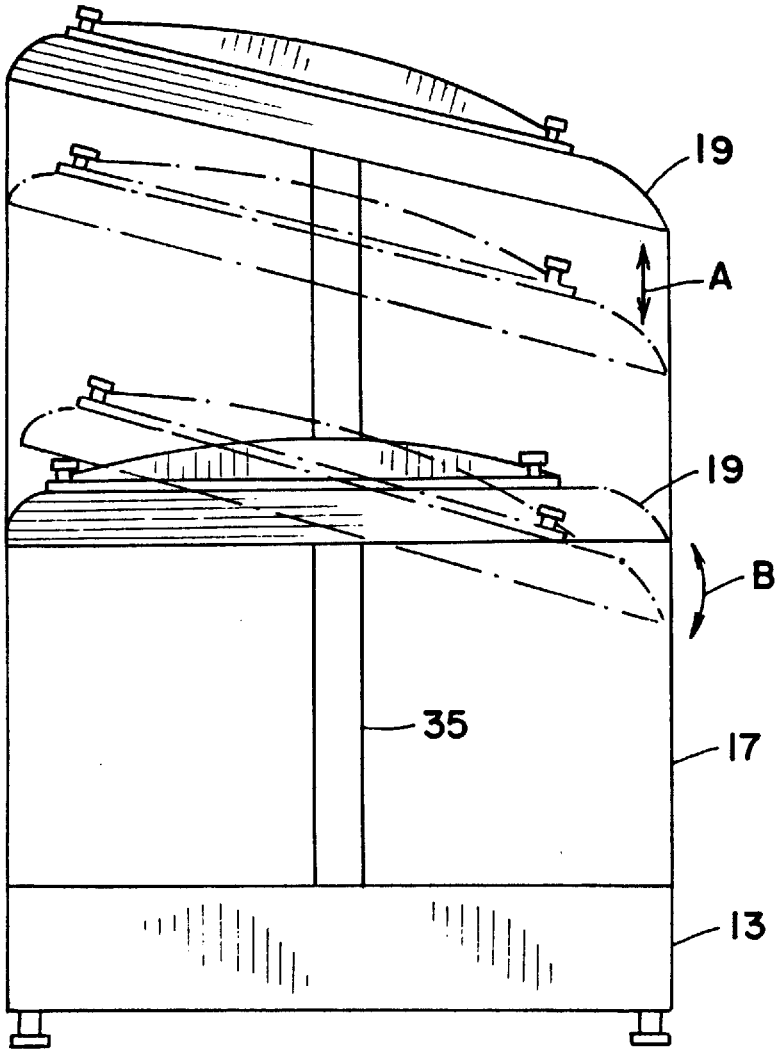
FIG. 3 is a side view of the inventive web guide showing angular and vertical adjustability.

With reference now to FIG. 3, the decks 19 can be both vertically and angularly adjustable with respect to either the axis of the web during its travel or the support 17.

The upper deck 19 shown in FIG. 3 is depicted in cross-hatch in a vertical adjustment, the vertical adjustment designated by the letter A. A channel 35 could be provided in the support 17 to allow the deck 19 to move up and down. The actual mechanism for vertical adjustment between the deck 19 and support 17 could be any known mechanism in the art. For example, the deck 19 could be mounted to a rack which is movable within the support 17 either by manual force, a crank or the like. Any other means could also be utilized to provide the vertical adjustment.

The lower rack 19 shown in cross hatch in FIG. 3 is depicted with an angular adjustment, the angular adjustment designated by the letter B. In this mode, the rack 19 could rotate about a pivot point (not shown) where the rack is movably mounted to the support 17. This pivotal arrangement could take the form of a pin upon which the rack is mounted for pivotal movement, the pin extending laterally from the support 17. The pin could also travel vertically for the vertical adjustment described above. Again, other means of angular adjustment as would be recognized by those skilled in the art could be utilized with the inventive web guide.

Although two racks are depicted in FIGS. 1–3, the inventive web guide 10 could have one or more than two racks as would be necessary with a given mail handling system. Each rack could be either fixed or adapted for one or more of the angular, horizontal and vertical adjustments described above. Likewise, the vacuum devices could be provided on one of a plurality of rack or all racks, if desired.

The racks 19 could also include position locking mechanisms to ensure that the racks remain in a given orientation after adjustment for a given web.

With the inventive web guide, the gyrations of a web when being dispensed from a form feeder are controlled so that the web perforations are presented at their strongest attitude to the cutter 5. Much higher accelerations can be tolerated without tearing of the webs.

With the vertical, horizontal and angular adjustment capability of the web guide, various size materials can be guided. Further flexibility is provided when using the vacuum devices.

When using at least two racks, the racks would extend laterally from a given support. If one rack were to be used, a single support could be used which could be positioned either laterally of the rack or therebeneath. Other configurations and shapes of the racks 19 and frame 11 could also be utilized to provide the guiding of the web.

In the method aspect of the invention, the travel of the web exiting the form feeder is controlled by the guiding surfaces of the guide device 10 to avoid web gyration, premature perforation of the webs or other problems which may be caused if the webs tend to whip out of control during operation of the mail handling system. The web guide provides particular control when the angular, vertical and/or horizontal adjustment is used for a given web. Even more control is provided when the vacuum devices are utilized to apply the downward force onto the web for controlled travel.

Although a mail handling system using a cutter is exemplified in FIG. 1, any system handling a continuum of work can utilize the inventive web guide for work support.

As such, an invention has been disclosed in terms of preferred embodiments thereof which fulfill each and everyone of the objects of the present invention as set forth hereinabove and provides a new and improved web guide for a mail handling system.

Of course, various changes, modifications and alterations from the teachings of the present invention may be contemplated from those skilled in the art without departing from the intended spirit and scope thereof. Accordingly, it is intended that the present invention only be limited by the terms of the appending claims.

We claim:

1. A web guide apparatus that is operative to guide a web from a web feeder to a web cutter comprising:

a) a frame having a base and an upstanding support extending therefrom; and b) at least one web guide deck extending from said upstanding portion, the at least one web guide deck having a web guide surface, the at least one web guide deck being vertically adjustable with respect to the upstanding support to accommodate webs being fed to the web guide in varying heights and being angularly adjustable with respect to the web guide surface to receive and guide webs at varying angles, wherein the at least one web guide deck includes at least one fan mounted below the web guide surface with an inlet of the fan disposed on the web guide surface to draw a vacuum on a web during web travel along the web guide surface.

2. The web guide apparatus of claim 1 wherein the upstanding support includes a pair of web guide decks.

3. The web guide apparatus of claim 2 wherein each web guide deck has upstanding walls on both sides of said web guiding surface, each of the upstanding walls being horizontally adjustable to accommodate webs of varying width.

4. The web guide apparatus of claim 1 further comprising a control for said at least one fan to regulate the vacuum for different types of webs.

* * * * *